US011376189B2

(12) United States Patent
Butler et al.

(10) Patent No.: US 11,376,189 B2
(45) **Date of Patent: *Jul. 5, 2022**

(54) CHEST COMPRESSION MONITOR WITH ROTATIONAL SENSING OF COMPRESSIONS FOR DISCRIMINATION OF CPR MOVEMENT FROM NON-CPR MOVEMENT

(71) Applicant: ZOLL Medical Corporation, Chelmsford, MA (US)

(72) Inventors: Gideon Butler, Portsmouth, NH (US); Gary A Freeman, Waltham, MA (US)

(73) Assignee: ZOLL Medical Corporation, Chelmsford, MA (US)

( * ) Notice: Subject to any disclaimer, the term of this patent is extended or adjusted under 35 U.S.C. 154(b) by 1000 days.

This patent is subject to a terminal disclaimer.

(21) Appl. No.: 16/101,120

(22) Filed: Aug. 10, 2018

(65) Prior Publication Data

US 2019/0091098 A1 Mar. 28, 2019

Related U.S. Application Data

(63) Continuation of application No. 14/616,544, filed on Feb. 6, 2015, now Pat. No. 10,071,017, which is a continuation of application No. 13/677,209, filed on Nov. 14, 2012, now Pat. No. 8,951,213.

(51) Int. Cl.
*A61H 31/00* (2006.01)

(52) U.S. Cl.
CPC ..... *A61H 31/005* (2013.01); *A61H 31/007* (2013.01); *A61H 31/008* (2013.01); *A61H 2201/5069* (2013.01); *A61H 2201/5084* (2013.01); *Y10S 128/92* (2013.01)

(58) Field of Classification Search
CPC .... A61H 31/00; A61H 31/004; A61H 31/005; A61H 31/007; A61H 2201/5007; A61H 2201/5058; A61H 2201/5061; A61H 2201/5064; A61H 2201/5066; A61H 2201/5071; A61H 2201/5074; A61H 2201/5079; A61H 2201/5094; A61B 5/0048; A61B 5/0053; A61B 5/72; A61B 5/7203; A61B 5/7207; A61B 5/721
See application file for complete search history.

(56) References Cited

U.S. PATENT DOCUMENTS

| | | | |
|---|---|---|---|
| 4,590,801 | A | 5/1986 | Merhav |
| 5,831,164 | A | 11/1998 | Reddi et al. |
| 6,178,357 | B1 | 1/2001 | Gliner et al. |
| 6,306,107 | B1 | 10/2001 | Myklebust et al. |
| 6,390,996 | B1 | 5/2002 | Halperin et al. |
| 6,567,102 | B2 | 5/2003 | Kung |
| 6,827,695 | B2 | 12/2004 | Palazzolo et al. |

(Continued)

*Primary Examiner* — Michael J Tsai
(74) *Attorney, Agent, or Firm* — ZOLL Medical Corporation

(57) ABSTRACT

A chest compression monitor for measuring the depth of chest compressions achieved during CPR. A sensor of the chest compression monitor is disposed within its housing such that compression of the housing due to CPR compressions, and its resultant deformation, is detected by the sensor and used by the control system as the starting point for calculating chest compression depth based on an acceleration signal indicative of the downward displacement of the chest.

39 Claims, 8 Drawing Sheets

(56) References Cited

U.S. PATENT DOCUMENTS

| | | | | |
|---|---|---|---|---|
| 7,122,014 | B2 | 10/2006 | Palazzolo et al. | |
| 7,220,235 | B2 | 5/2007 | Geheb et al. | |
| 7,245,974 | B2 | 7/2007 | Dupelle et al. | |
| 7,410,470 | B2 | 8/2008 | Escudero et al. | |
| 8,160,698 | B2 | 4/2012 | Elghazzawi et al. | |
| 8,744,542 | B2 * | 6/2014 | Ukawa | A61H 31/005 600/323 |
| 2007/0135739 | A1 | 6/2007 | Halperin et al. | |
| 2008/0146974 | A1 | 6/2008 | Lund et al. | |
| 2008/0171311 | A1 * | 7/2008 | Centen | G16H 20/30 434/265 |
| 2008/0300518 | A1 * | 12/2008 | Bowes | A61H 31/005 601/41 |
| 2010/0049266 | A1 * | 2/2010 | Ochs | A61H 31/005 607/5 |
| 2010/0228166 | A1 | 9/2010 | Centen | |
| 2010/0245114 | A1 | 9/2010 | Celik-Butler et al. | |
| 2012/0191024 | A1 | 7/2012 | Halperin et al. | |

* cited by examiner

CHEST COMPRESSION MONITOR WITH ROTATIONAL SENSING OF COMPRESSIONS FOR DISCRIMINATION OF CPR MOVEMENT FROM NON-CPR MOVEMENT

CROSS-REFERENCE TO RELATED APPLICATIONS

This application claims the benefit under 35 U.S.C. § 120 as a continuation of U.S. application Ser. No. 14/616,544, filed Feb. 6, 2015, now U.S. Pat. No. 10,071,017, issued Sep. 11, 2018, which claims benefit to U.S. application Ser. No. 13/677,209, filed on Nov. 14, 2012, now U.S. Pat. No. 8,951,213, issued Feb. 10, 2015, which are each incorporated by reference herein in their entirety.

FIELD OF THE INVENTIONS

The inventions described below relate the field of cardiopulmonary resuscitation (CPR).

BACKGROUND OF THE INVENTIONS

Chest compression monitoring during the course of CPR is now possible with the Real CPR Help® and CPR-D-padz technology marketed by ZOLL Medical Corporation. This technology is described in U.S. Pat. Nos. 6,390,996, 7,108,665, and 7,429,250, and includes the use of an accelerometer to measure accelerations of the chest and calculating the depth of each compression from the acceleration signal. The technology is used in ZOLL's Real CPR Help® compression depth monitoring system to provide real-time rate and depth CPR feedback for manual CPR providers. Commercially, it is implemented in ZOLL's electrode pads, such as the CPR-D-padz® electrode pads. It is also implemented for training use in the PocketCPR® chest compression monitor and PocketCPR® iPhone app.

U.S. Pat. No. 6,390,996 to Halperin, as well as U.S. Pat. No. 7,122,014 to Palazzolo, described chest compression monitors capable of determining chest compression depth accurately during repeated rapid chest compressions required by CPR. The devices of Halperin and Palazzolo were adapted to be placed between the CPR provider's hand and the patient's sternum during CPR. In both cases, the CPR chest compression monitor is held in fixed relationship to the chest during use, and the chest compression module is operable to determine the depth of each chest compression based on acceleration data from accelerometers in the chest compression module, without input from other sources, especially without input of data from other sensors fixed in space or remote from the compression module. The disclosures of U.S. Pat. Nos. 6,390,996, 7,108,665, and 7,429,250 to Halperin, and U.S. Pat. No. 7,122,014 to Palazzolo are hereby incorporated by reference.

Various other chest compression monitors have required or suggested the use of additional inputs to detect the initiation of a compression. Myklebust et al., System for Measuring and Using Parameters During Chest Compression in a Life-Saving Situation or a Practice Situation and Also Application Thereof, U.S. Pat. No. 6,306,107 (Oct. 23, 2001) describes a device which uses a pressure pad containing an accelerometer and requires a force activated switch to determine the start of each compression in order to determine the depth of depressions. However, Myklebust does not provide a means to measure compression depth using an accelerometer alone, nor does Myklebust account for some kinds of error in the measured value of chest compression depth (such as drift). Our own prior patent, Palazzolo, et al., Method of Determining Depth of Compressions During CPR, U.S. Pat. No. 7,122,014 (Oct. 17, 2006) after describing methods of determining compression depth with such additional inputs, also describes the use of switches to detect the start of compressions that may be beneficial in discriminating between acceleration due to chest compressions and external acceleration of the patient.

SUMMARY

The devices and methods described below for improved accuracy of a chest compression monitor to be used to aid in the proper application of CPR. This is accomplished by detecting the starting point of chest compressions by detecting deformation of a compression monitor, or a component of the compression monitor, that is associated with the beginning of a compression stroke. For example, the accelerometers used in the compression monitor can be used to detect the beginning of a compression stroke by allowing the accelerometers within the chest compression monitor to rotate within the chest compression monitor in response to applied compressive forces. This is accomplished by modifying a chest compression monitor described in U.S. Pat. No. 6,390,996 to Halperin. Halperin discloses a hand-held CPR chest compression monitor that accurately measures the rate and depth of chest compressions during the administration of CPR. The CPR compression monitor is adapted to be secured in fixed relation to a cardiac arrest victim's chest, with a housing, including accelerometers, a processor, and output means such as a display and speaker. The system provides for measuring and prompting chest compressions to facilitate the effective administration of CPR. The device provides prompts to the rescuer to encourage correct compressions. A signaling mechanism provides signals corresponding to chest compression depth and frequency of compressions achieved by a rescuer, and provides prompts to help the CPR provider provide compressions within desired frequency range and maintain the chest displacement within a desired distance range.

The chest compression monitor comprises accelerometers for determining an amount of CPR induced motion of the chest in relation to the spine. A control system within an associated AED, or within a housing which houses the accelerometer, converts an output signal produced by the motion detector into a distance value. The control system compares the distance value to a desired range of distance values, and operates a signaling mechanism for signaling directions regarding chest compression depth and frequency in accordance with whether the value falls within the desired range of distance values. The chest compression monitor can also be operated to provide a signal corresponding to the distance value to an associated chest compression device.

To assist in determining the starting point of a chest compression, the accelerometer and its mounting board are disposed within the accelerometer such that they naturally rotate or twist while moving downwardly and upwardly during chest compressions, but do not typically rotate or twist when moving downwardly or upwardly due to external accelerations that may be caused, for example, by transporting the patient in a vehicle. The control system is programmed to integrate the acceleration signal to determine the depth of numerous repeated compressions, using the signal corresponding to rotation to determine the starting point of each compression, while ignoring acceleration signals indicative of downward motion that are not accompanied by acceleration signals indicative of rotation.

Other sensors which detect the deformation of other components of the chest compression monitor may also be used to detect the start and end of a compression. For example, in conjunction with a housing that may deflect, bend or twist during compressions, strain gauges, piezoresistive elements, impedance sensors embedded in the housing may be used to detect flexion of the housing which occurs only due to the action of chest compression, and will not be effected by ambient motion.

In addition to detecting the start of each compression to enhance the compression depth calculations, the system may also be used to detect the end of compressions, including the rapidity and completeness of release of compressive forces after a compression. When used in conjunction with manual CPR compressions, the device can provide prompts to a rescuer, indicating that the rescuer is removing the downward forced on the patient too slowly, and prompting the rescuer to quickly and completely release the chest and remove any compressive force after each compression stroke.

DETAILED DESCRIPTION OF THE INVENTIONS

Figure 1:
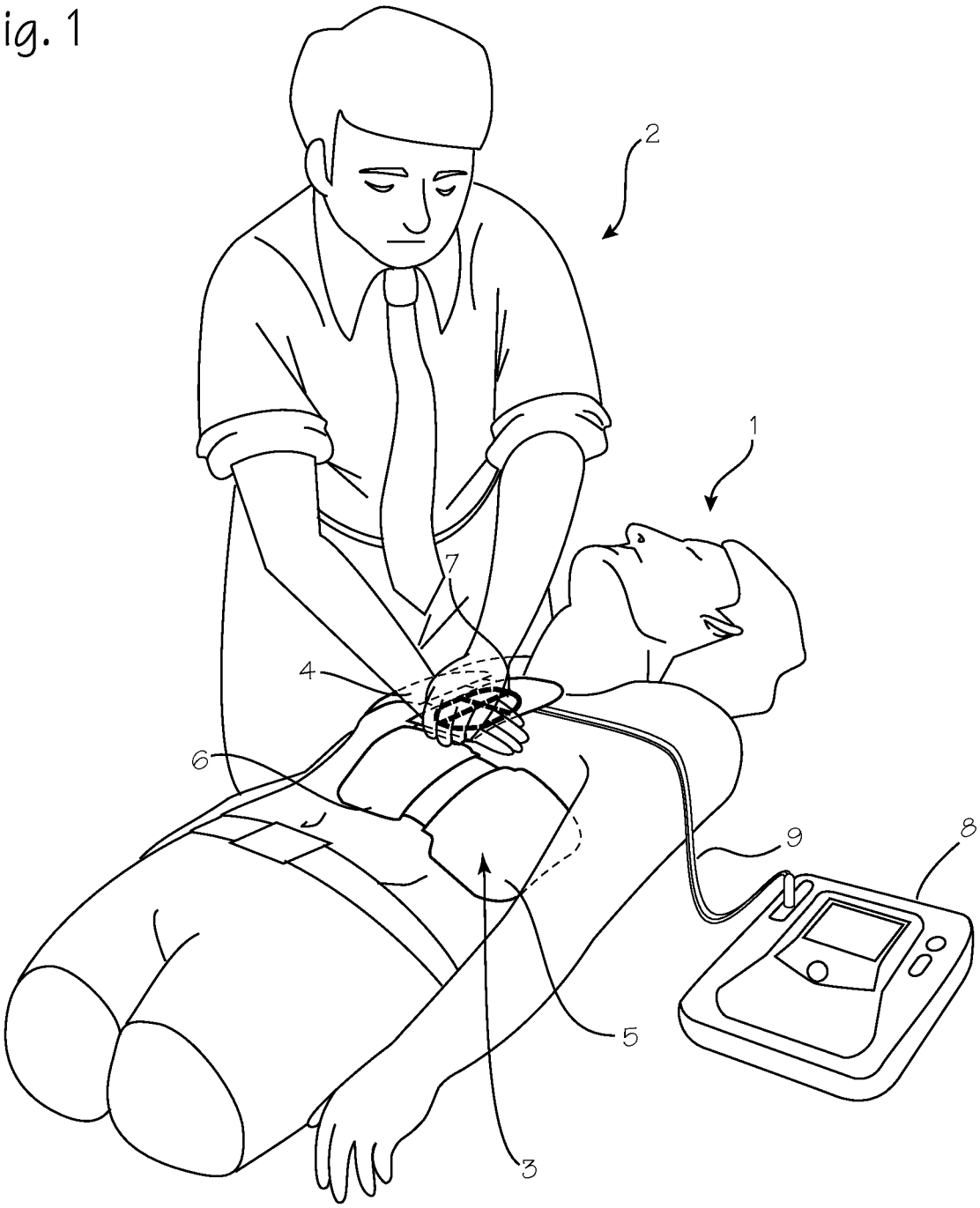
FIG. 1 illustrates the use of a chest compression monitor in use on a patient, with a rescuer providing manual chest compressions.

FIG. 1 illustrates the use of a chest compression monitor in use on a patient 1, with a rescuer 2 providing manual chest compressions. As part of the resuscitation effort, the rescuer has applied an ECG electrode assembly 3 on the patient's chest. This assembly includes a sternum electrode 4, an apex electrode 5, and sternal bridge 6. A chest compression monitor 7 is disposed within the sternal bridge, sandwiched between layers of foam that comprise the bridge. The bridge, along with the cross-hair indicia, serves as a template for proper placement of the chest compression monitor over the sternum of the victim which, together with the configuration of the bridge, ensures that the sternal and apex electrodes are properly placed (for patients of a wide variety of sizes). The electrode assembly is connected to a defibrillator 8 (through cable 9) which is fitted with a control system or systems capable of controlling (and programmed to control) ECG and defibrillating functions and capable of controlling (and programmed to control) the compression monitor functions of interpreting acceleration signals from the compression monitor, determining the depth of compressions from those acceleration signals, and generating and providing feedback to the rescuer. The feedback may be both audio feedback provided through an annunciator or visual feedback provided on a display. These compression monitor functions can also be accomplished by a control system built into the compression monitor itself, as described in Halperin and as practiced by our PocketCPR® device. The feedback can include prompts to compress more deeply, prompts to compress at a faster or slower rate, and prompts to quickly and completely release the chest of the patient after each compression.

Figure 2:
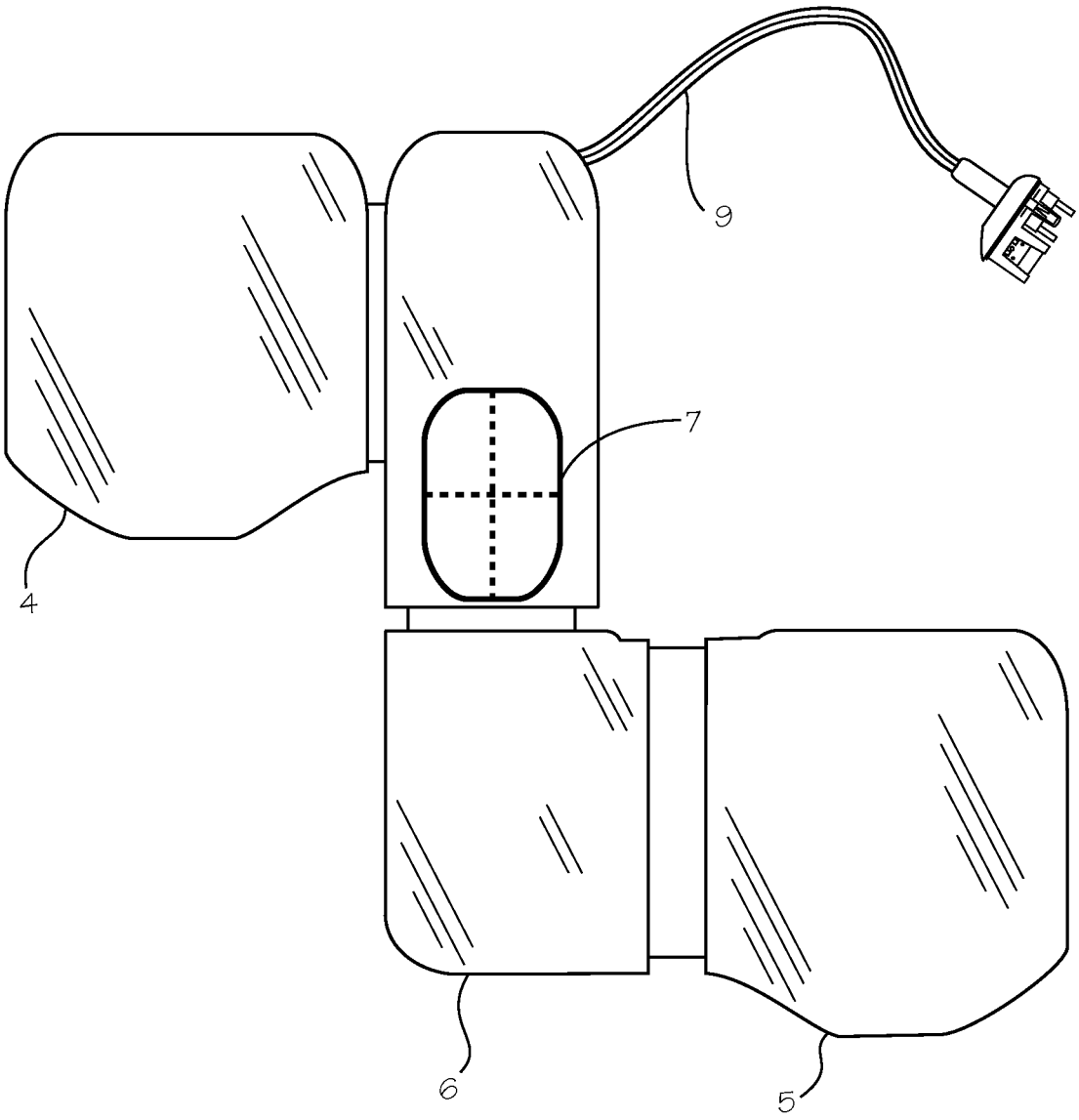
FIG. 2 is a top view of the electrode assembly FIG. 1.

FIG. 2 is a top view of the electrode assembly of FIG. 1, which includes the chest compression monitor 7. In this view, the location of the sternal electrode 4 and apex electrode 5, and the chest compression monitor 7 within the bridge 6 are more clearly shown. The chest compression monitor is disposed within the electrode locating bridge shown in FIG. 1, sandwiched between layers of foam, so that, when applied to the patient, the CPR chest compression monitor is disposed over the sternal notch of the patient. This chest compression monitor and its housing are referred to as a puck in the developing art.

Figure 3:
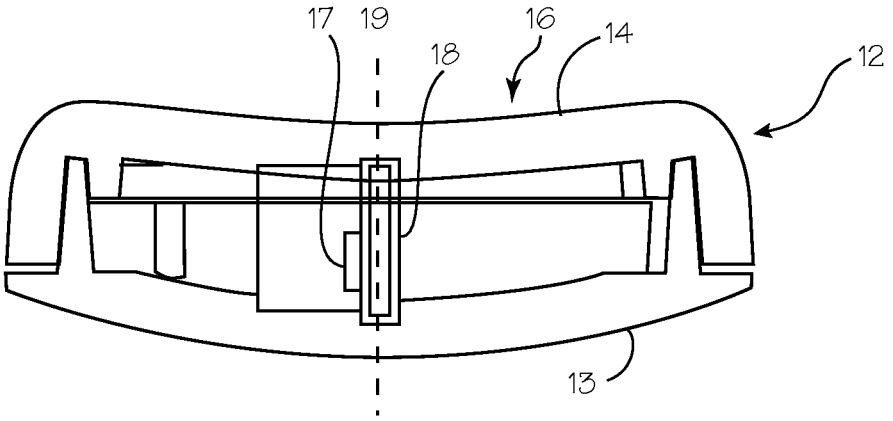
FIG. 3 illustrates the chest compression monitor as implemented in ZOLL Medical's Real CPR Help® chest compression monitor.

FIG. 3 illustrates the chest compression monitor 7 as implemented in ZOLL Medical's Real CPR Help® chest compression monitor and CPR stat padz or CPR-D-padz®. The puck includes a housing 12 with a housing bottom portion 13 and housing top portion 14. The housing bottom portion has a slightly convex bottom surface 15 (which opposes the chest, or anterior surface of the patient's thorax), to conform to the patient's sternal notch. The housing top portion has a slightly concave top surface 16 (superficial, relative to the patient) which facilitates hand placement over the puck during use. The accelerometer assembly 17 that measures acceleration of the puck is disposed in its packaging and on a mounting board 18. Typically, accelerometer assembly is a multi-axis accelerometer assembly, with two or three distinct accelerometers arranged orthogonally to each other, capable of detecting acceleration on two or three orthogonal axes. Preferably, the axes are aligned in the compression monitor to coincide with the compression axis 19 (typically, the vertical axis which corresponds to the anterior/posterior axis of the patient when supine) and one or two axes orthogonal to the compression axis (typically two horizontal axes). With this arrangement, chest compression depth can be measured, as described in the Halperin patent. The accelerometer assembly may also comprise separate accelerometers, with two or three accelerometers rotatably mounted to the housing. Alternately, as described below in relation to FIG. 7, the device may employ a first, fixed accelerometer disposed within the housing and a second, rotatable accelerometer disposed within the housing.

Figure 4:
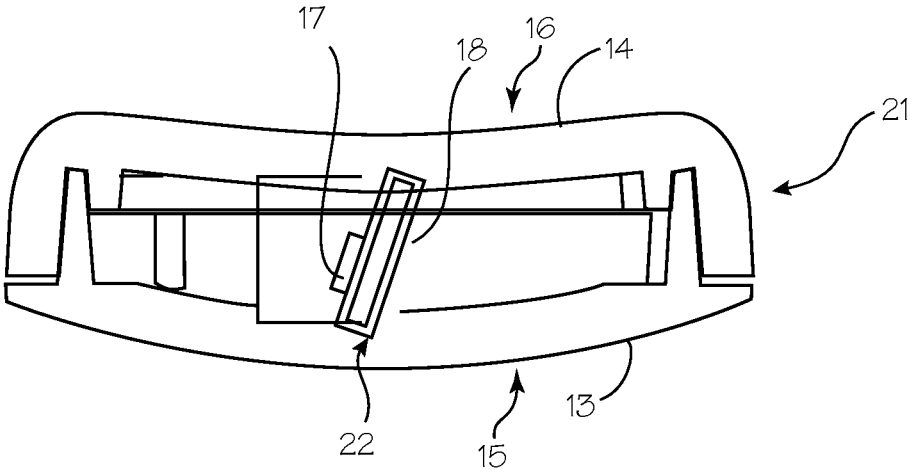
(prior art) Fig. 4
FIGS. 4 and 4*a* illustrate the chest compression monitor of FIG. 3 modified to discriminate between acceleration due to compressions and acceleration due to environmental movement of the patient.
Figure 4A:
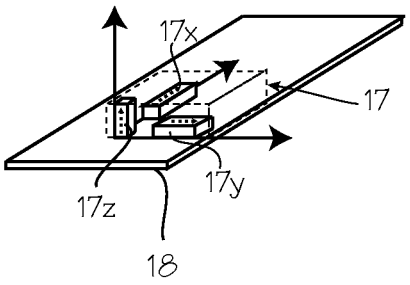

The basic device of FIG. 3 can be modified as shown in FIG. 4, which illustrates the chest compression monitor of FIG. 3 modified to discriminate between acceleration due to compressions and acceleration due to environmental movement of the patient. The housing 21 is modified such that the top surface 16 is slightly flexible, to a degree that it flexes downwardly when compressive force is applied to the top surface. In this device, the accelerometer mounting board 18 is inclined, relative to the compression axis, and rotatably fixed to the housing, for example at a pivot point 22, such that it can rotate relative to the housing. Because the accelerometer mounting board is tilted, compressive forces applied to the top surface will result in both downward movement of the puck and rotation of the mounting board, and rotation of the multi-axis (3-axis or 2-axis) accelerometer assembly, about the pivot point 22. (The accelerometer mounting board can be fixed to the housing with a hinge or flex joint, or it may be floated in foam or gel within the housing, or merely fixed to the housing bottom portion and housing top portion. It is biased toward its original tilted position through its connection to the resilient portion of the housing, but may be biased with a spring.) The accelerometer assembly is disposed on the mounting board, and thus fixed to the housing, with a predetermined relationship between the accelerometer axes and the axes of the housing, which in turn is configured to be placed in a predetermined relationship to the anatomy of the patient. FIG. 4*a* illustrates the multi-axis accelerometer assembly 17 and mounting board 18, with the three distinct accelerometers 17*x*, 17*y* and 17*z* arranged orthogonally to each other, capable of detecting acceleration on three orthogonal axes. Preferably, one of the accelerometers will be disposed relative the mounting board and housing such that its axis of sensitivity is aligned with the compression axis. The device of FIG. 4 may be incorporated into the electrode assembly as shown in FIGS. 1 and 2, or it can be used in a stand-alone chest compression monitor, similar to our PocketCPR® chest compression monitor and the puck disclosed in Halperin.

In this arrangement, compressions which force the accelerometer assembly downward will also rotate the accelerometer mounting board. The multi-axis accelerometer will sense the downward motion and the rotation. The rotation will indicate the start of a compression, and the control system will interpret the accelerometer data from the several accelerometers to calculate the downward displacement of the compression monitor, which corresponds to the depth of the CPR compression. Though the calculations will differ depending on the initial orientation of the accelerometers, the calculations are routine once the inventive concept is understood. By detecting the start of compressions with the accelerometer data, the device can more accurately calculate the compression depth, and ignore accelerations caused by other forces acting on the patient and the compression depth monitor.

Figure 5:
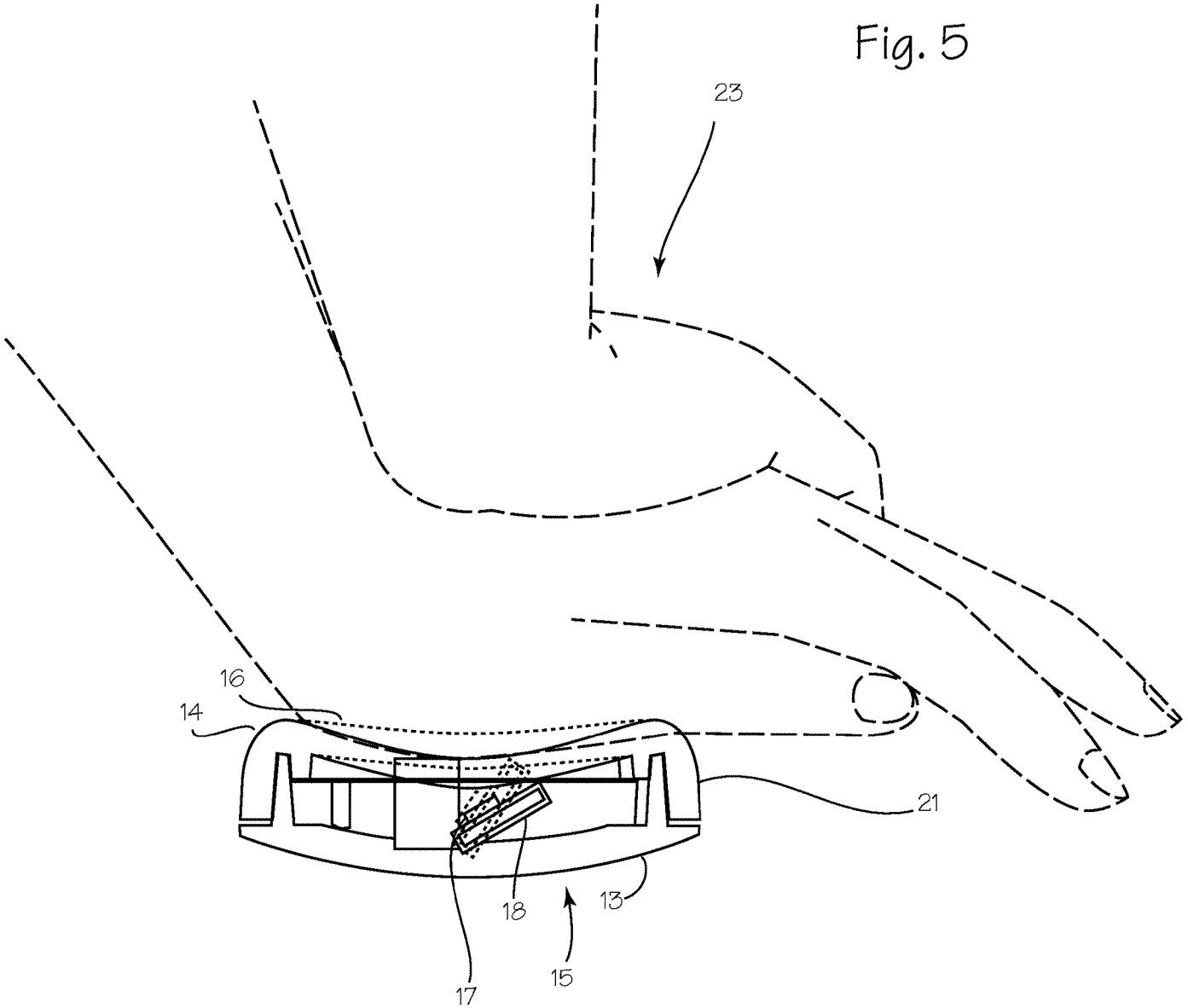
FIGS. 5 and 6 illustrate the flexion of the housing top portion and rotation of the accelerometer assembly.

FIG. 5 illustrates the flexion of the housing top portion and rotation of the accelerometer assembly. FIG. 5 illustrates rotation of the accelerometer assembly as a result of the rescuer's compression effort. The rescuer is trained and/or prompted through instructions on the electrode assembly to place his/her hands 23 on the puck 21, such that the heel of the hand rests in the concavity of the housing top portion, and perform CPR compressions according to ACLS guidelines. During each compression, the rescuer will push downwardly on the housing, and force the housing top portion 14 to flex and deform to a more concave shape, and thus force the accelerometer assembly to rotate relative to housing, away from its original slightly tilted position to a more tilted position. This rotation will be sensed by the accelerometers of the accelerometer assembly, and the accelerometers will produce an acceleration signal corresponding to the rotation of the accelerometer assembly within the housing, and also the vertical and horizontal displacement of the housing. The accelerometer signal corresponding to the vertical displacement of the housing corresponds to the chest wall displacement, or compression depth, achieved by the manually applied compressions.

In the device illustrated in FIGS. 4 and 5, the accelerometers of the two or three axis accelerometer are the only sensors needed to determine the start of the compression, and thereafter calculate the depth of compression. The calculations are made, and compression depth of numerous repeated compressions is calculated, without reference to signals other than the accelerometers, or signals from sensors not located on, or disposed in fixed relationship to the housing, and without reference to a signal derived from a source external to the module. The housing or module, which is adapted to seat on the patient's chest with an upper surface adapted to accommodate and seat the rescuer's palm, is thus adapted to be held in fixed relationship to the patient's chest and move in conjunction with the anterior surface of the patient's chest and follow the movement of the chest of a patient undergoing compression. The accelerometers are fixed to the housing, and thus move in conjunction with the housing and the anterior surface of the patient's chest. The accelerometers output an acceleration signal indicative of the upward and downward acceleration of the chest, as well as the rotation of the accelerometer assembly within the housing. The associated control system is programmed to receive and process the acceleration signals to determine the depth of chest compression and produce a compression signal indicative of the depth of compression of the patient's chest. The control system is 11 further programmed to determine the start of a compression based on accelerometer signals from the accelerometers which are indicative of rotation of the accelerometer assembly, without reference to a signal derived from a source external to the module, and without reference to a signal derived from a source which is not coupled to the patient's chest, and thereafter calculate downward displacement of the chest using the acceleration signal. The control system is further programmed to output a compression signal indicative of the calculated displacement, and, based on comparison of the calculated displacement with predetermined desired displacement and rate of compressions, provide prompts to the rescuer indicating the quality of compressions (for example, indicating whether the displacement achieved is inadequate, adequate, or excessive).

The control system used in the device may be any suitable computer control system, and may be disposed within the housing, within an associated defibrillator, or within an associated chest compression device, or it may be a general purpose computer or a dedicated single purpose computer. The control system may comprise at least one processor and at least one memory including program code stored on the memory, where the computer program code is configured such that, with the at least one processor, when run on the processor, it causes the processor to perform the functions assigned to the control system throughout this specification. These functions include interpreting the accelerometer signals from the accelerometers, and/or signal produced by other sensors, to determine compression depth, and produce signals indicative of the calculated compression depth, and operate outputs such as audio speakers or displays to provide feedback to a rescuer, or use those signals as feedback for the control system of a chest compression device.

Figure 6:
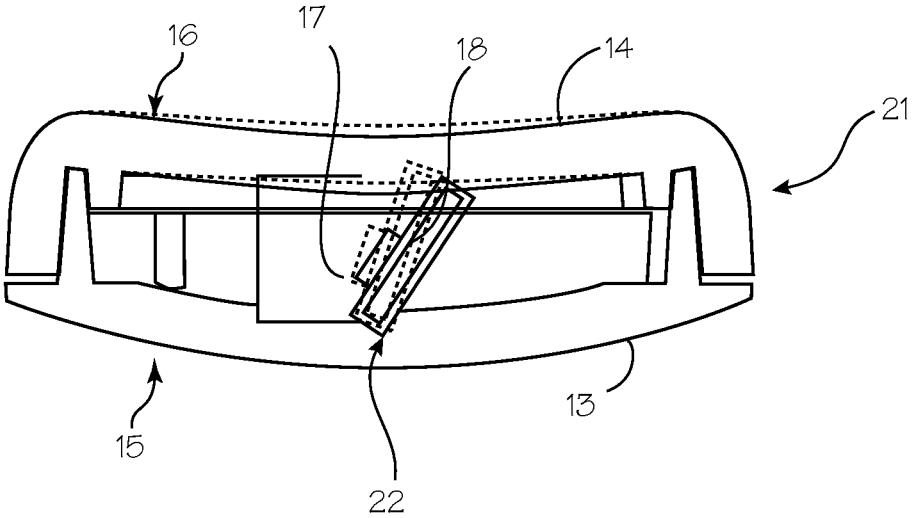

The device described above can also be used to determine whether a rescuer is substantially releasing the chest after each compression. Complete release of the compressive weight of the rescuer is necessary to ensure that the thorax of the patient can expand, due to its natural resilience, as quickly as possible and without the hindrance of the rescuer's weight. This is described in our U.S. Pat. No. 7,220,235 to Freeman, incorporated herein by reference. As described in Freeman, an optimum compression cycle is characterized by very quick release of the compression force applied by the rescuer, between each application of downward force. That is, between compressions, it is desirable to completely and immediately remove the compression force of the rescuer's weight from the patient's chest, rather that slowly remove the force and thereby restrict the resilient expansion of the patient's thorax. Release of the rescuer's weight and the attendant downward force will result in the resilient return housing upper surface 16 to its original, slightly concave shape, and thus result in return of the rotating accelerometer assembly to its original slightly tilted position. The immediacy of this return is thus indicative of the rapidity of the rescuer's release of compressive force. The control system used to measure chest displacement may thus be programmed to calculate the rapidity of the release of compressive forces and output a release signal indicative of the calculated release rate, and, based on comparison of the calculated release rate with predetermined desired release rate, and operate a speaker or display to provide prompts to the rescuer indicating whether the release achieved between compressions is inadequate or adequate. With this prompting, the rescuer can be prompted to avoid resting his or her weight on the patient between compressions. A compression cycle includes a compression stroke and a decompression release. Upon release, the rescuer should remove all of his/her weight from the patient's chest. During the compression stroke, the accelerometer assembly will be tilted (or other component will be deformed), but after the compression stroke, any remaining tilt indicates that accelerometer assembly is still impacted by the rescuer. Even though the entire device is moving upward, a restraint on upward movement by the rescuer's hand will result in some detectable tilt. Upon detection of overall upward movement with remaining tilt of the accelerometer assembly, which in indicative of incomplete release, the control system operates the display or speaker to prompt the rescuer to more completely release the chest after each compression. This determination and prompting can be used in combination with, or in lieu of, the determinations and prompting disclosed in U.S. Pat. No. 7,220,235, such as the determination that the rescuer does not reach the original starting point of compression (that is, the top of the compression cycle). FIG. 6 illustrates the configuration of the housing top portion and accelerometer assembly when the rescuer fails to completely remove his/her weight or compressive force from the puck. The housing top portion 14 is only partially returned to its original position, limited in its return by a rescuer who has failed to completely release compressive force. In turn, the accelerometer assembly 17 is only partially rotated back to its original slightly tilted position. The accelerometer signals from the accelerometers are interpreted by the control system, and will indicate that the accelerometer assembly has not been rotated back to its original position.

Figure 7:
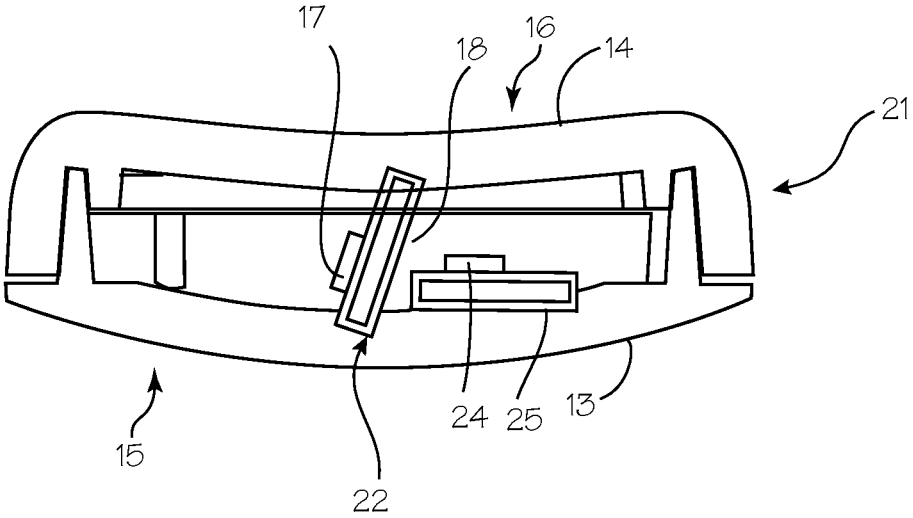
FIG. 7 illustrates the chest compression monitor with both a rotating accelerometer assembly and a fixed, non-rotating accelerometer.

FIG. 7 illustrates the chest compression monitor with both a rotating accelerometer assembly similar to that of FIG. 4 and a fixed, non-rotating accelerometer assembly 24 mounted on a second circuit board 25 which is also non-rotatably fixed to the housing (that is, it does not rotate relative to the housing). This additional accelerometer assembly is non-rotatably fixed to the housing 12, such that it produces accelerometer signals indicative of vertical movement, lateral movement, and also rotation of the housing. These additional accelerometer signals can be used as an adjunct to the accelerometer signals provided by the rotatable accelerometer assembly 17. The remainder of the compression monitor is similar to FIG. 4, including the housing top portion 14, the housing bottom portion 13, the rotating accelerometer assembly 17. In this mode of use, the compression depth is determined using the accelerometer signal of the rotatable accelerometer assembly, and the start of compressions is determined by the detection of rotation of the rotatable accelerometer assembly, while the fixed accelerometer assembly detects rotations of the housing. The control system is programmed to determine the chest compression depth based on the accelerometer signal of the rotatable accelerometer assembly, and the start of compressions as indicated by the detection of rotational acceleration signals received from the rotatable accelerometer assembly. The control system is further programmed to adjust the calculation of compression depth or the start of a compression based on acceleration signals received from the fixed accelerometer. For example, if acceleration signals from the fixed accelerometer indicate the housing has rotated in conjunction with the rotatable accelerometer assembly (that is, both assemblies indicate a similar rotation), the control system will determine that any change in depth of the housing is a result of spurious movement, and not the result of a CPR chest compression accomplished by the rescuer.

In a complementary mode of operation, the fixed accelerometer assembly 24 can be used as the primary acceleration sensor, as described by Halperin, U.S. Pat. No. 6,390,996, while the rotatable accelerometer assembly 17 is used merely to detect the starting point for each compression. In this mode of operation, the control system is programmed to determined chest compression depth based on the acceleration signals from the fixed accelerometer, while determining the starting point for each compression from the accelerometer signal indicate of rotation received from the rotatable accelerometer assembly.

Figure 8:
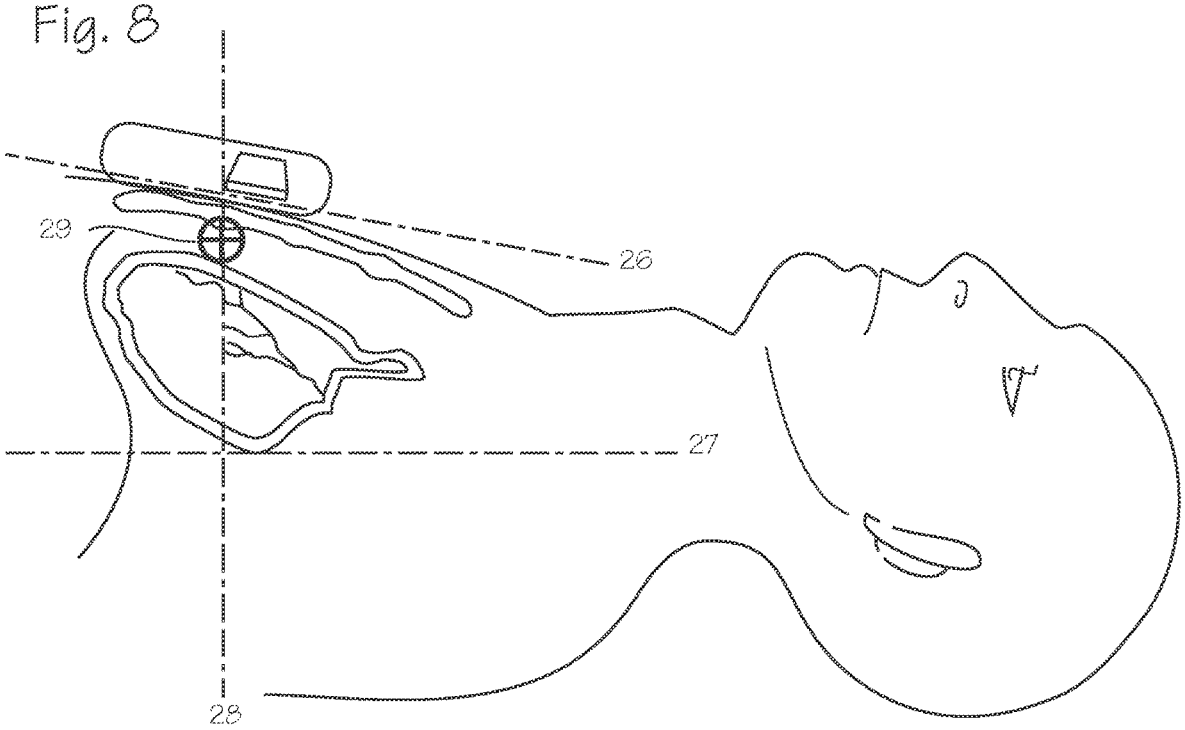
FIGS. 8 and 9 illustrate the orientation of the device on a patient, such that natural tilting of the sternum and/or rib cage during compression is distinguishable from rotation of the rotatable accelerometer assembly caused by compression applied by the rescuer.
Figure 9:
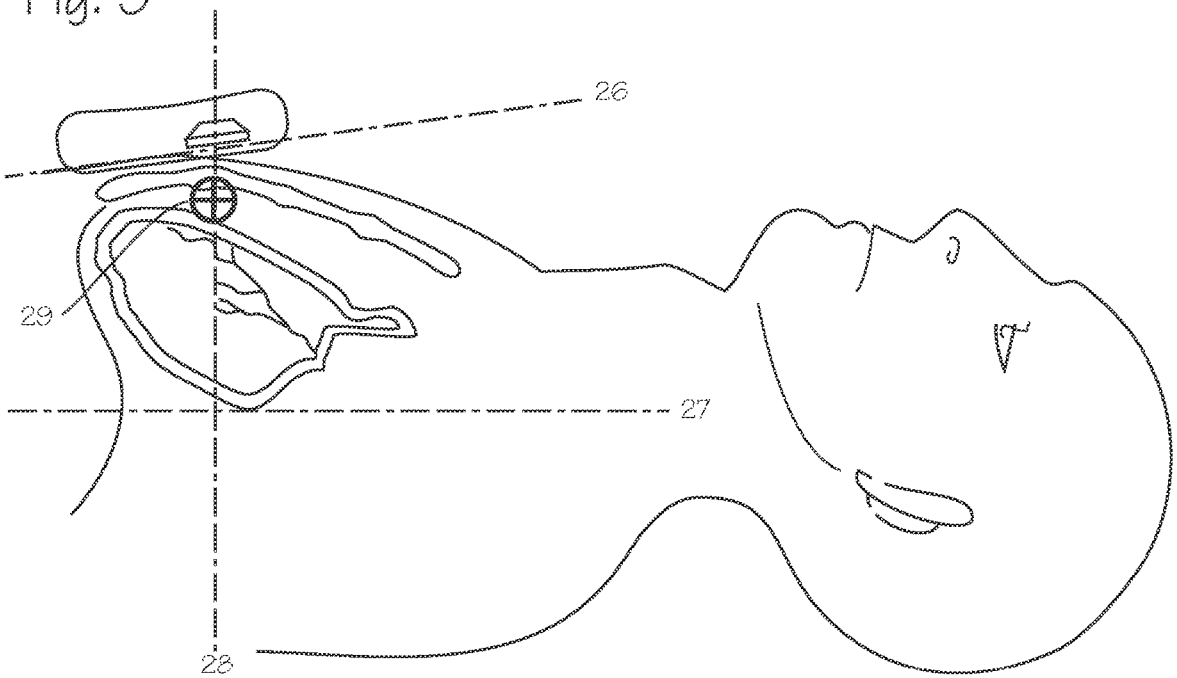

FIGS. 8 and 9 illustrate the orientation of the device on a patient, such that natural tilting of the sternum and/or rib cage during compression is distinguishable from rotation of the rotatable accelerometer assembly caused by compression applied by the rescuer. The accelerometer assembly provides a means for discriminating between inferior/superior tilting of the compression monitor and lateral tilting of the assembly. This is helpful to avoid confusing inferior/posterior tilting of the xiphoid process with the tilt of the accelerometer assembly within the housing. The xiphoid process tends to compress differentially compared to the sternum, such that a compression monitor mounted on the chest, at the sternal notch, may tilt along the inferior/superior axis of the patient. The accelerometer assembly is mounted within the housing such that is hinge line is parallel to the inferior/superior axis, and the assembly rotates about this hinge line, back and forth across the lateral/medial axis of the device. Proper alignment of the accelerometer assembly on the body is ensured by the initial placement of the assembly on the electrode assembly, and proper application of the electrode assembly on the patient's body. As shown in FIG. 8, the hinge line 26 is defined as the line about which the accelerometer assembly 17 rotates in response to CPR compressions and the resultant deformation of the housing top portion. The superior/inferior axis 27 of the patient is the head-to-toe axis of the patient. The anterior/posterior axis 28 extends from the front (anterior) of the patient to the back (posterior) of the patient. A lateral/medial axis, indicated by arrow 29, extends from one side of the patient to the other. (The origins of the axes illustrated are arbitrarily placed relative to the patient.) The sternum of some patients tends to compress differentially. The inferior end of the sternum may be pressed deeper than the intermediate portions, so that the lower portion of the sternum and the xiphoid process "tilt" across a lateral/medial axis or plane of the patient, or rotate within an anterior/posterior plane of the patient (or the device), without tilting substantially about an inferior/superior axis of the patient (or the device). As shown in FIG. 9, the lower portion of the sternum and the xiphoid process have, in response to compressions, tilted about lateral/medial axis 29 (and correspondingly tilted across the lateral/medial plane established by the patient and the device, but has not tilted about the superior/inferior axis or twisted in a horizontal lateral/medial plane or about the anterior/posterior axis. That is, the device has not rocked back and forth across the chest, or rotated on the anterior surface of the chest wall. Thus, the hinge line about which the accelerometer assembly rotates is aligned with the superior/inferior axis of the patient, and perpendicular to an anterior/posterior axis and a lateral/medial axis (without necessarily being parallel to a superior/inferior axis: in practice the hinge line will lie in an anterior/posterior plane). This ensures that rotation of the accelerometer assembly is most likely due to deformation due to compression, rather than tilt of the device as it follows a sternum tilting about a lateral/medial axis. The desired alignment can be ensured by disposing the accelerometer assembly and circuit board within the housing, and providing indicia on the housing, to promote placement on the body of the patient such that the hinge line is substantially within an anterior/posterior plane of the patient's body. Referring to FIG. 2, this is accomplished by placement of the housing within an electrode assembly, which must be placed on the patient's body to properly locate the sternum and apex electrodes. Highly trained rescuers, or even novice users, can properly place the electrodes given the indicia typically provided on the surface of the electrode assembly.

Figure 10:
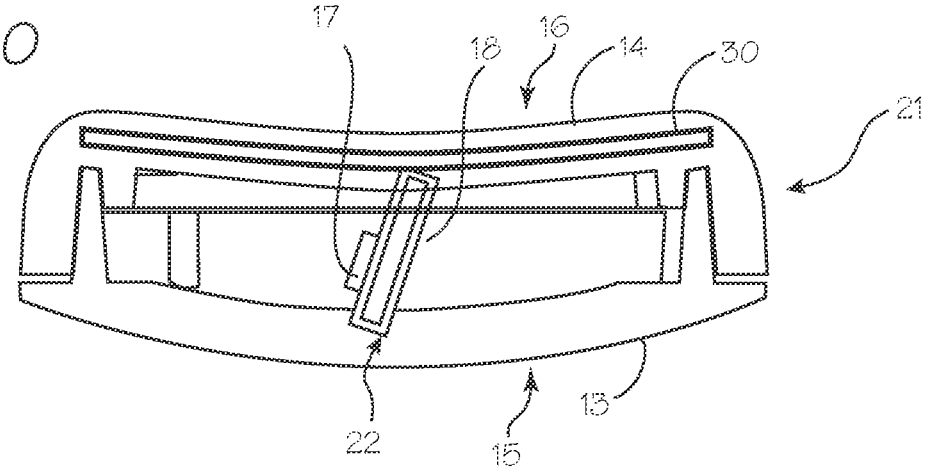
FIGS. 10 and 11 illustrate chest compression devices with additional means for detecting deformation of the housing caused by compression forces.
Figure 11:
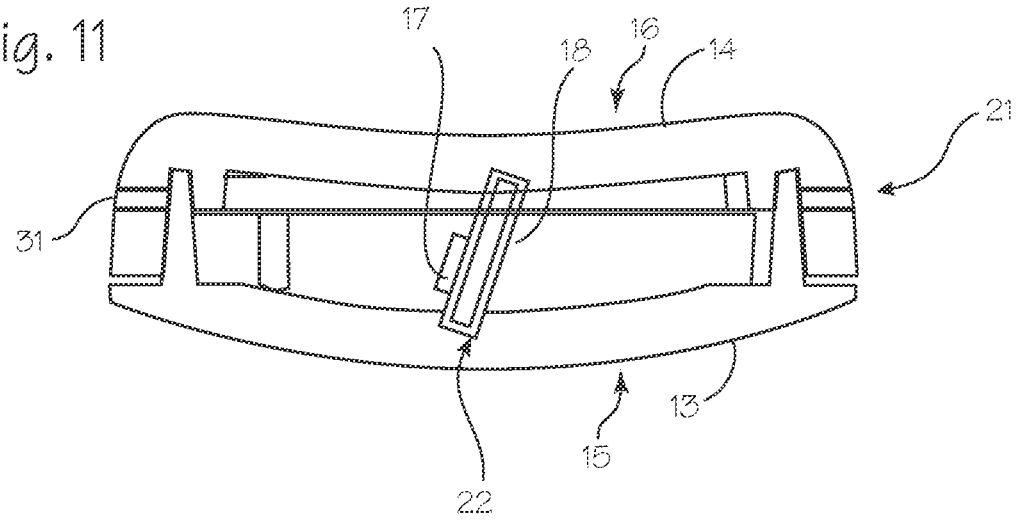

FIGS. 10 and 11 illustrate chest compression devices with additional means for detecting deformation of the housing caused by compression forces. The chest compression monitor illustrated in FIG. 10 includes the housing 12, with a bottom portion and a top portion and an accelerometer assembly 17 and circuit board 18 (which may be fixed relative to the housing or rotatable relative to the housing). A strain gauge 30 is embedded in the housing top portion 14, which is slightly flexible, soft, or deformable, so that the rescuer will deform the top portion, and thus the strain gauge, each time the rescuer pushes on the patient's chest. Deformation of the strain gauge will result in a change of resistance of elements within the strain gauge, which is communicated to the control system. The abrupt change of resistance incident to the start of a compression is interpreted by the control system as the start of the compression, and the control system is programmed to calculate the chest compression depth using the accelerometer signals from the accelerometer assembly, using the starting position as identified by resistance measurement from the strain gauge. The strain gauge, which detects deformation of the housing, may be disposed within any portion of the housing, which deforms during compressions, including the sidewall and the bottom portion, so long as those portions comprise a material that may deform slightly during compressions.

The chest compression monitor illustrated in FIG. 11 includes the housing 12, with a bottom portion and a top portion and an accelerometer assembly 17 and circuit board 18 (which may be fixed relative to the housing or rotatable relative to the housing). A force sensitive resistor 31 is disposed within the housing, and as illustrated is disposed between the top portion 14 and the bottom portion, so that the rescuer will deform the top portion and thus impact the top portion upon the force sensitive resister, each time the rescuer pushes on the patient's chest. Impingement of the top portion on the force sensitive resistor will result in a change of resistance of force sensitive resistor, which is communicated to the control system. The abrupt change of resistance incident to the start of a compression is interpreted by the control system as the start of the compression, and the control system is programmed to calculate the chest compression depth using the accelerometer signals from the accelerometer assembly, using the starting position as identified by resistance measurement from the force sensitive resistor. As appears from FIGS. 10 and 11, the housing upper surface may comprise, at least in part, a piezo-resistor, a strain gauge (including a micro-strain gauge), a pressure sensitive touch screen, or any other sensor operable to detect deformation of the housing, or any other means for detecting a deformation of the housing. The means for detecting deformation of the housing can be disposed on, or be embedded in, the housing top portion, the housing bottom portion, and any part of the chest compression device subject to detectable stress and/or strain during compressions.

Figure 12:
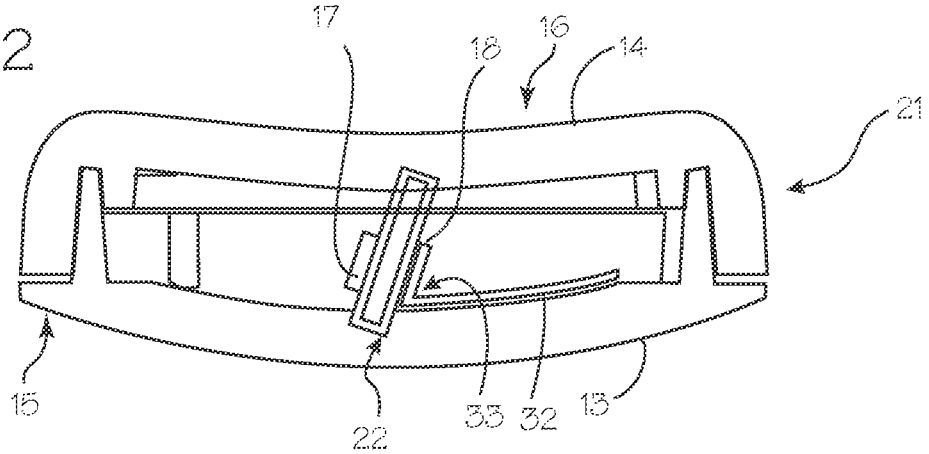
FIG. 12 illustrates a means for indirectly detecting deformation of the housing as an indicator of the start of a compression.

In addition to directly detecting deformation of the housing as an indication of the start of a compression as illustrated in FIGS. 10 and 11, deformation may be detected indirectly by detecting rotation of the accelerometer assembly or deflection of some other component which is rotated or deflected when the housing is deformed. FIG. 12 illustrates a means for indirectly detecting deformation of the housing as an indicator of the start of a compression. FIG. 12 includes the puck 12 with the housing bottom portion 13, housing top portion 14, the accelerometer assembly 17 and its mounting board 18 rotatably disposed between the housing bottom portion 13 and the housing top portion 14 so that compression of the housing top portion toward the bottom portion forces the accelerometer assembly to rotate about a pivot point such as point 22. A piezoelectric film 32 is fixed to both the housing (the bottom portion in FIG. 12) and the accelerometer assembly or mounting board, and is folded along crease 33. Upon each application of compressive force, the accelerometer assembly rotates about the pivot 22, and bends the piezoelectric film 32. Deformation of the piezoelectric film creates a voltage spike within the film, which is detected by appropriate electronics and communicated to the control system. The control system interprets the voltage spike incident to deflection of the film as the start of a compression. The piezoelectric film provides a means to detect rotation of the accelerometer assembly and mounting board. Other means for detecting rotation of the accelerometer assembly and mounting board may be used in place of the piezoelectric film, including a force transducer, force switch, relay switch positioned, a piezo-resistor, a strain gauge (including a micro-strain gauge), a pressure sensitive touch screen, or any other sensor operable to detect rotation of the accelerometer and/or mounting board disposed under the accelerometer assembly and mounting board, or, more generally, operably connected to the accelerometer and/or mounting board such that the sensor can detect compression induced motion of the accelerometer and/or mounting board. Additionally, the means for detecting rotation may be operably connected to any structure or component that moves within the puck in response to compressions. The electrode assembly may be rotationally fixed within the housing, as illustrated in FIG. 7 (items 24 and 25 refer to a fixed accelerometer), and a rotating board or other component (with or without accelerometers) may be used to impinge upon or interact with the means for detecting rotation.

In use, the compression depth monitor is used by a CPR provider while providing CPR compressions to a patient. The CPR provider will place the chest compression monitor over the sternum of the patient, between his or her hands and the patient's chest, and perform compressions manually (or, as illustrated below, between a chest compression device and the patient's chest, and perform compressions with the chest compression device). The CPR provider may also install ECG/defibrillator electrodes on the patient, with the chest compression monitor integrated into an electrode assembly as shown in FIGS. 1 and 2. The CPR provider will operate the chest compression monitor, and its control system will interpret the acceleration signals as described above to determine chest wall displacement, using the start of rotation, or deformation of the housing, as an indication that a compression has started, and will use the point at which the rotation or deformation is detected as the starting point for calculating compression depth. The control system will compare the calculated compression depth to a desired, predetermined compression depth (2 inches, under current ACLS guidelines), and operate a speaker or display to provide prompts to the user regarding the quality of compressions. The control system may also output a compression signal indicative of the calculated displacement. Likewise, if used to assess the quality of release of compressions based on the rate at which the sensors rotate back to their original position, or the housing rebounds to its original uncompressed shape, the control system will compare the calculated release rate to a desired, predetermined release rate, and operate a speaker or display to provide prompts to the user regarding the quality of release.

Figure 13:
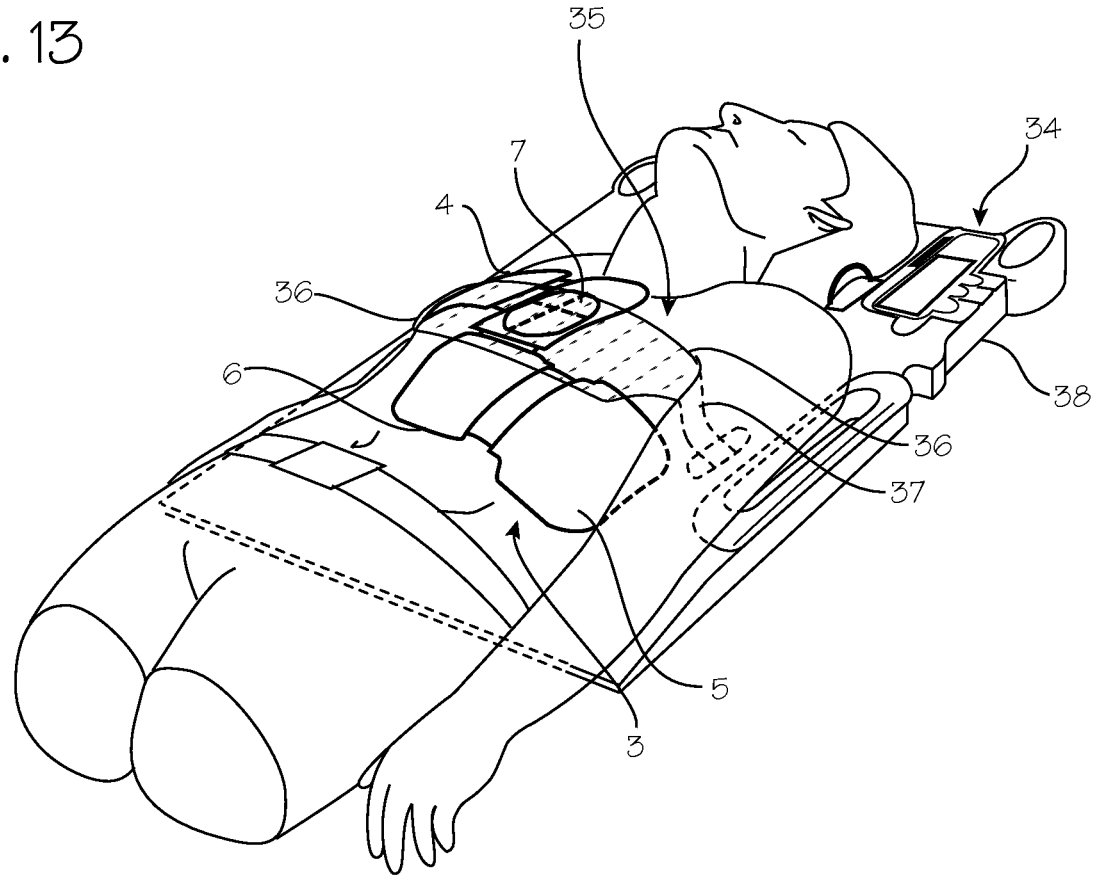
FIG. 13 illustrates the use of a chest compression monitor in use on a patient, with a chest compression device installed on the patient.

FIG. 13 illustrates the use of a chest compression monitor in use on a patient, with a chest compression device 34 installed on the patient 1. The chest compression device is described in our U.S. Pat. No. 7,410,470, and includes a compression belt 35 (shown in phantom) with load distributing panels 36 and pull straps 37 (one on each side of the patient) attached to a drive spool and a motor within the housing 38. As illustrated in this view, the ECG electrode assembly 3 is disposed on the patient's chest, under the load distributing band. This assembly includes the sternum electrode 4, the apex electrode 5, the sternal bridge 6 and the chest compression monitor 7 illustrated in FIG. 1. The chest compression monitor and electrodes may be connected to a defibrillator directly, or through connection built into the housing. The chest compression monitor is disposed between the patient and load distributing panels, above the sternum of the patient.

Figure 14:
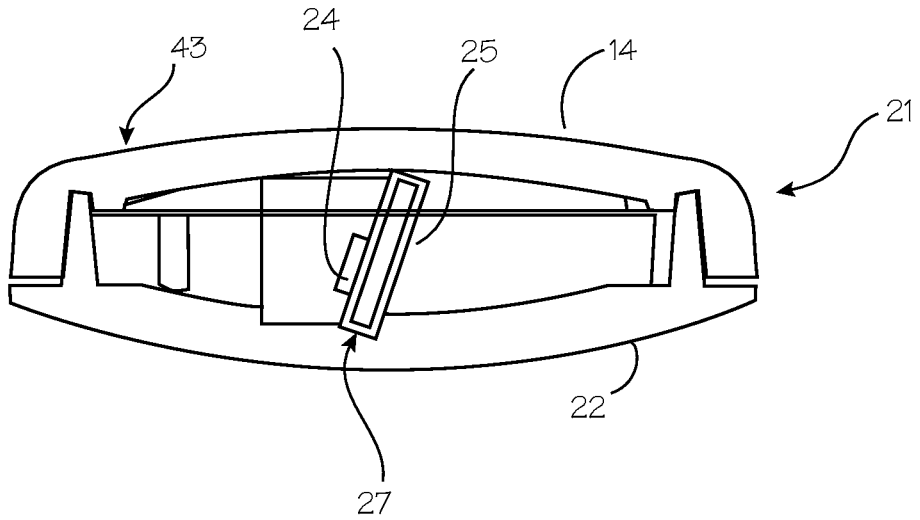
FIG. 14 illustrates the chest compression monitor, with a rotatable accelerometer, adapted for use with a chest compression device as illustrated in FIG. 13.

FIG. 14 illustrates the chest compression monitor adapted for use with the chest compression device 34. This compression monitor includes the rotatable accelerometer, and the housing is adapted for use with a chest compression device as illustrated in FIG. 13. The outer surface 43 of the housing top portion 14 is convex, though it may be flat, so that the belt of the chest compression device is certain to impinge upon the housing top portion and deform it, so as to cause the rotatable accelerometer assembly to rotate during each compression. In other respects, the compression monitor is similar to the device shown in FIG. 4.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. A chest compression monitoring system for facilitating administration of cardiopulmonary resuscitation (CPR) to a patient by a CPR provider, the chest compression monitoring system comprising:

a housing configured to be held between the hands of the CPR provider and the chest of a patient during chest compressions and comprising:

a first motion sensor disposed within the housing and configured to generate one or more first signals indicative of motion of the first motion sensor;

a second motion sensor disposed within the housing and configured to generate one or more second signals indicative of motion of the second motion sensor, wherein the first motion sensor and the second motion sensor are configured to move relative to one another; and a medical device comprising a processor, a memory, and an output device, wherein the processor is configured to:

receive, from the first motion sensor and the second motion sensor, the one or more first signals and the one or more second signals, analyze motion of the first motion sensor relative to the second motion sensor based on the one or more first signals and the one or more second signals;

estimate at least one chest compression parameter based on the analyzed motion of the first motion sensor relative to the second motion sensor; and control the output device to provide chest compression feedback for the CPR provider based at least on part on the estimated at least one chest compression parameter.

2. The system of claim 1, wherein the first motion sensor is configured to move relative to the housing and the second motion sensor is fixed relative to the housing.

3. The system of claim 2, wherein the first motion sensor is configured to move relative to the housing in response to the compressive forces applied to the housing by the CPR provider.

4. The system of claim 3, wherein an upper portion of the housing is configured to deform in response to compressive forces applied to the housing by the CPR provider and further wherein the first motion sensor is configured to move relative to the housing in response to the deformation.

5. The system of claim 3, wherein the first motion sensor is configured to rotate relative to the housing in response to the compressive forces applied to the housing by the CPR provider.

6. The system of claim 1, wherein the at least one chest compression parameter comprises chest displacement of the patient.

7. The system of claim 6, wherein the processor is configured to estimate a chest displacement due to the chest compressions based on the estimated at least one chest compression parameter and the one or more second signals.

8. The system of claim 1, wherein the processor is configured to estimate a chest displacement due to the chest compressions based on the at least one chest compression parameter and on one of the one or more first signals and the one or more second signals.

9. The system of claim 8, wherein the processor is configured to provide the chest compression feedback based on the at least one chest compression parameter.

10. The system of claim 1, wherein the at least one chest compression parameter comprises a rate of chest release.

11. The system of claim 10, wherein the processor is configured to provide the chest compression feedback based on a comparison between the rate of chest release and a predetermined desired rate of chest release.

12. The system of claim 1, wherein the at least one chest compression parameter comprises a chest compression rate.

13. The system of claim 10, wherein the chest compression feedback comprises chest compression rate feedback.

14. The system of claim 1, wherein the output device is configured to provide one or more of audible feedback and visual feedback.

15. The system of claim 1, wherein the first motion sensor comprises one or more first accelerometers and wherein the second motion sensor comprises one or more second accelerometers.

16. The system of claim 1, wherein the medical device is a defibrillator.

17. The system of claim 1, wherein the at least one chest compression parameter comprises determination of at least one of a start of chest compressions and an end of chest compressions.

18. The system of claim 17, wherein the start of chest compressions is determined based on a determination of a downward motion and rotation of at least one the first motion sensor and the second motion sensor.

19. The system of claim 1, wherein the at least one chest compression parameter comprises determination of depth of chest compressions during the chest compressions.

20. The system of claim 1, wherein the at least one chest compression parameter comprises determination of resilience of the chest of the patient during the chest compressions.

21. The system of claim 1, wherein the at least one chest compression parameter comprises determination of rapidity of release of the chest compressions provided to the patient.

22. A method of facilitating administration of cardiopulmonary resuscitation (CPR) chest compressions to a patient by a CPR provider, the method comprising:

receiving, from a first motion sensor and a second motion sensor, one or more first signals and one or more second signals, wherein the first motion sensor and the second motion sensor are disposed in a same housing;

analyzing motion of the first motion sensor relative to motion of the second motion sensor based on the one or more first signals and the one or more second signals;

estimating at least one chest compression parameter based on the analyzed motion of the first motion sensor relative to the motion of the second motion sensor; and controlling an output device to provide chest compression feedback for the CPR provider based on the estimated at least one chest compression parameter.

23. The method of claim 22, wherein the one or more first signals and the one or more second signals are indicative of motions of the first motion sensor and the second motion sensor relative to one another.

24. The method of claim 22, wherein estimating the at least one chest compression parameter comprises estimating a chest displacement due to the chest compressions based on the one or more first signals.

25. The method of claim 22, wherein estimating the at least one chest compression parameter comprises estimating a chest displacement due to the chest compressions based on the one or more second signals.

26. The method of claim 22, wherein the one or more first signals are indicative of motion of the first motion sensor relative to the housing in response to compressive forces applied to the housing by the CPR provider.

27. The method of claim 22, wherein estimating the at least one chest compression parameter comprises estimating chest displacement due to the chest compressions based on the estimated at least one chest compression parameter and on one of the one or more first signals and the one or more second signals.

28. The method of claim 27, wherein estimating the at least one chest compression parameter comprises estimating the chest compression feedback based on a comparison between the chest displacement due to the chest compressions and a predetermined desired chest displacement.

29. The method of claim 22, wherein estimating the at least one chest compression parameter comprises estimating a rate of chest release based on the estimated at least one chest compression parameter and on one of the one or more first signals and the one or more second signals.

30. The method of claim 29, wherein providing the chest compression feedback comprises a comparison between the rate of chest release and a predetermined desired rate of chest release.

31. The method of claim 22, comprising:

processing one or more of the one or more first signals and the one or more of the second signals to determine a chest compression rate; and controlling the output device to provide chest compression rate feedback.

32. The method of claim 22, wherein controlling the output device to provide chest compression feedback comprises controlling the output device to provide the chest compression feedback as one or more of audible prompts and visual prompts.

33. The method of claim 22, wherein the one or more first signals and the one or more second signals are acceleration signals.

34. The method of claim 22, wherein estimating at least one chest compression parameter includes determining at least one of a start of chest compressions and an end of chest compressions.

35. The method of claim 22, wherein the at least one chest compression parameter comprises determining of at least one of a start of chest compressions and an end of chest compressions.

36. The method of claim 35, wherein the start of the chest compressions is determined based on determining of a downward motion and rotation of at least one the first motion sensor and the second motion sensor.

37. The method of claim 22, wherein the at least one chest compression parameter comprises determining of depth of chest compressions during the chest compressions.

38. The method of claim 22, wherein the at least one chest compression parameter comprises determining of resilience of the chest of the patient during the chest compressions.

39. The method of claim 22, wherein the at least one chest compression parameter comprises determining rapidity of release during the chest compression provided to the patient during the chest compressions.

* * * * *